US005749293A

United States Patent [19]

Ota et al.

[11] Patent Number: 5,749,293

[45] Date of Patent: May 12, 1998

[54] INKING APPARATUS FOR USE IN PRINTING PRESS

[75] Inventors: Hisaki Ota; Takamasa Nakamura, both of Tokyo-To, Japan

[73] Assignee: Dai Nippon Printing Co., Ltd., Japan

[21] Appl. No.: 623,527

[22] Filed: Mar. 29, 1996

[30] Foreign Application Priority Data

Apr. 5, 1995 [JP] Japan ..... 7-080458

[51] Int. Cl.[6] ..... B41F 31/07; B41F 31/20

[52] U.S. Cl. ..... 101/157; 101/350.5

[58] Field of Search ..... 101/157, 169, 101/350, 363, 364, 350.1, 350.2, 350.5, 350.6, 207, 208, 210; 118/259, 261

[56] References Cited

U.S. PATENT DOCUMENTS 2,631,532 3/1953 Harless ..... 101/157

FOREIGN PATENT DOCUMENTS 3911839 10/1990 Germany ..... 101/366

*Primary Examiner*—J. Reed Fisher

*Attorney, Agent, or Firm*—Parkhurst & Wendel

[57] ABSTRACT

In an inking apparatus for use in a printing press, an ink pan located below a plate cylinder is separated into a first part which accommodates a furnisher roll for furnishing ink and a second part which receives contaminated ink containing foreign substance scraped off a doctor blade. In order to prevent the ink within the second part from flowing directly into the first part, partitions are provided, or alternatively the second part is positioned lower than the first part, or alternatively the first part and the second part are comprised of two separate receptacles. The supply of ink to the plate cylinder may be carried out by any suitable means other than the furnisher roll. The ink pan may be configured in the form of an exclusive receptacle adapted to receive only the contaminated ink containing foreign substance scraped off the doctor blade, the supply of ink to the plate cylinder being effected without passing through the ink pan. Thus, high-grade quality ink to be supplied to the plate cylinder is prevented from contamination.

11 Claims, 8 Drawing Sheets

INKING APPARATUS FOR USE IN PRINTING PRESS

BACKGROUND OF THE INVENTION

1. Field of the Invention

The present invention relates to an inking apparatus for use in a printing press such as a gravure printing press.

2. Description of the Related Art

In a typical known inking apparatus for use in a gravure printing press, an ink pan is positioned below a plate cylinder and a furnisher roll is rotatably mounted so as to be partially immersed in ink within the ink pan. The furnisher roll is maintained in contact with the peripheral surface of the plate cylinder and by its rotation delivers the ink to the surface of the plate cylinder for the adhesion of the ink therearound. After the ink adheres to the surface of the plate cylinder for printing, surplus ink is removed by a doctor blade with the rotation of the plate cylinder. An impression cylinder is provided in press-contact with the top surface of the plate cylinder so that a web of paper is passed through between the plate cylinder and the impression cylinder to be subjected to a printing operation.

Ink retained in the ink pan is discharged through an outlet into an ink tank. The ink stored within the tank is transmitted by the action of a pump to a filter for removing foreign substance from the ink and then to a viscosity/temperature controller for controlling the viscosity and temperature of the ink, and is changed again into a high quality level of ink, which is returned to the ink pan.

During the printing operation, the high quality level ink within the ink pan is supplied into cells of the plate cylinder by means of the furnisher roll, while the doctor blade scrapes the ink which has overflown the cells, the thus scraped ink falling into the ink pan by the action of gravity. At this time, the falling ink may contain foreign substance which is generated by friction between the doctor blade and the surface of the plate cylinder. This foreign substance may adhere to the surface of the plate cylinder to cause trouble or may mix into the high-grade quality ink in the ink pan, thus adversely affecting the control of its viscosity, temperature and so on. The above type of inking apparatus is disclosed for example in JP-U-4-41971 published Oct. 2, 1992.

SUMMARY OF THE INVENTION

It is therefore the object of the present invention to solve the above problem of surplus ink which may adversely affect high-grade quality ink to be furnished to the surface of the plate cylinder.

According to an aspect of the present invention, in order to achieve the above object, an inking apparatus for use in a printing press is provided which includes an ink pan, a plate cylinder positioned above the ink pan, means for furnishing ink onto a surface of the plate cylinder, and a doctor blade provided in contact with the surface of the plate cylinder for removing surplus ink resting on the surface of the plate cylinder, wherein the inking apparatus comprises ink flow prevention means for preventing surplus ink which has fallen into the ink pan from the area of contact of the doctor blade with the surface of the plate cylinder from flowing directly into an ink path of the means for furnishing ink onto the surface of the plate cylinder.

In the present invention, the ink pan may be comprised of a first part which receives ink to be furnished onto the surface of the plate cylinder and of a second part which receives surplus ink falling from the area of contact of the doctor blade with the surface of the plate cylinder.

According to the present invention, the ink flow prevention means may comprise a partition wall formed between the first part and the second part.

According to the present invention, the ink flow prevention means may comprise means interposed between the first part and the second part for imparting a hydraulic head by which the second part is lower than the first part.

The hydraulic head impartment means may be implemented by a sloped bottom wall of the ink pan. The ink flow prevention means may be implemented by two separate ink pans respectively defining the first and second parts. It is also possible that the ink pan is composed of a portion for receiving the ink to be furnished onto the surface of the plate cylinder.

The surface of the plate cylinder is supplied with high-grade quality ink by means for furnishing ink onto the surface of the place cylinder. Surplus ink is scraped off by the doctor blade and falls into the ink pan. At that time, foreign substance tends to mix into the falling ink. By the provision of the ink flow prevention means, the ink containing this foreign substance is prevented from flowing directly into the ink path of the means for furnishing high-grade quality ink onto the surface of the plate cylinder, and hence from mixing directly into the high-grade quality ink. This will ensure a certain quality level of the ink to be furnished onto the surface of the plate cylinder.

For a reliable prevention of ink flow, the ink flow prevention means may be comprised of the partition wall for partitioning the ink pan into the first part and the second part.

In order to prevent the ink flow by a head, it will also be possible to implement the ink flow prevention means by the head impartment means.

For preventing the ink flow, the head impartment means may be in the form of a sloped bottom wall of the ink pan, since it is impossible for the ink to flow against the ascending slope.

The prevention of the ink flow may also be accomplished by providing two separate ink pans respectively defining the first and second parts.

To fully prevent the ink containing foreign substance from mixing into the high-grade quality ink, the ink pan may be composed of a portion which receives the contaminated ink containing the foreign substance falling from the surface of the plate cylinder, while providing the high-grade quality ink supply path to the surface of the plate cylinder without passing through the interior of the ink pan.

BRIEF DESCRIPTION OF THE DRAWINGS

These and other aspects, features and advantages of the present invention will become more apparent from the following detailed description thereof when taken in conjunction with the accompanying drawings, in which.

DESCRIPTION OF THE PREFERRED EMBODIMENTS

Figure 12:
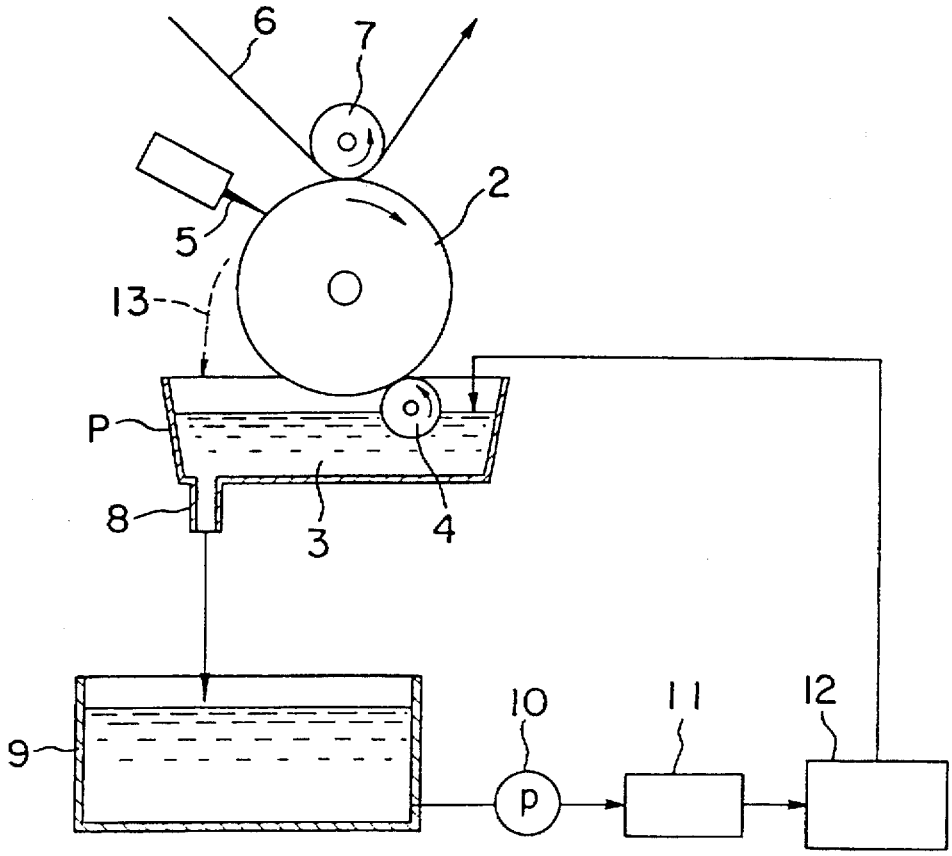
FIG. 12 PRIOR ART
FIG. 12 is a front elevational view partly in section of a conventional inking apparatus used in a printing press.

Prior to describing the invention in detail, the known inking apparatus referred to before will briefly be described with reference to FIG. 12 for the purpose of more fully understanding the nature and attendant problem of the prior art. An ink pan P is positioned below a plate cylinder 2 and a furnisher roll 4 is rotatably mounted so as to be partially immersed in ink 3 within the ink pan P. The furnisher roll 4 is maintained in contact with the peripheral surface of the plate cylinder 2 and by its rotation delivers the ink 3 to the surface of the plate cylinder 2 for the adhesion of the ink therearound. After the ink 3 adhense to the surface of the plate cylinder for printing, surplus ink is removed by a doctor blade 5 with the rotation of the plate cylinder 2 in the direction indicated by an arrow. An impression cylinder 7 is provided in press-contact with the top surface of the plate cylinder 2 so that paper 6 is passed between the plate cylinder 2 and the impression cylinder 7 to be subjected to printing operation.

The ink 3 retained in the ink pan P is discharged through an outlet 8 into an ink tank 9. The ink stored within the tank 9 is transmitted by the action of a pump 10 to a filter 11 for removing foreign substance from the ink and then to a viscosity/temperature controller 12 for controlling the viscosity and temperature of the ink, and is changed again into a high quality level of ink, which is returned to the ink pan P.

During the printing operation, the high quality level ink within the ink pan P is supplied into cells of the plate cylinder 2 by means of the furnisher roll 4, while the doctor blade 5 scrapes the ink which has overflown the cells, the thus scraped ink falling into the ink pan P by the action of gravity as indicated by an arrow of dotted line. At this time, the falling ink may contain foreign substance which is generated by friction between the doctor blade 5 and the surface of the plate cylinder. This foreign substance may adhere to the surface of the plate cylinder to cause trouble or may mix into the high-grade ink in the ink pan P, thus adversely affecting the control of its viscosity, temperature and so on.

The present invention will now be described in more detail with reference to the accompanying drawings, which illustrate preferred exemplary embodiments of the invention in a non-limitative manner.

Figure 1:
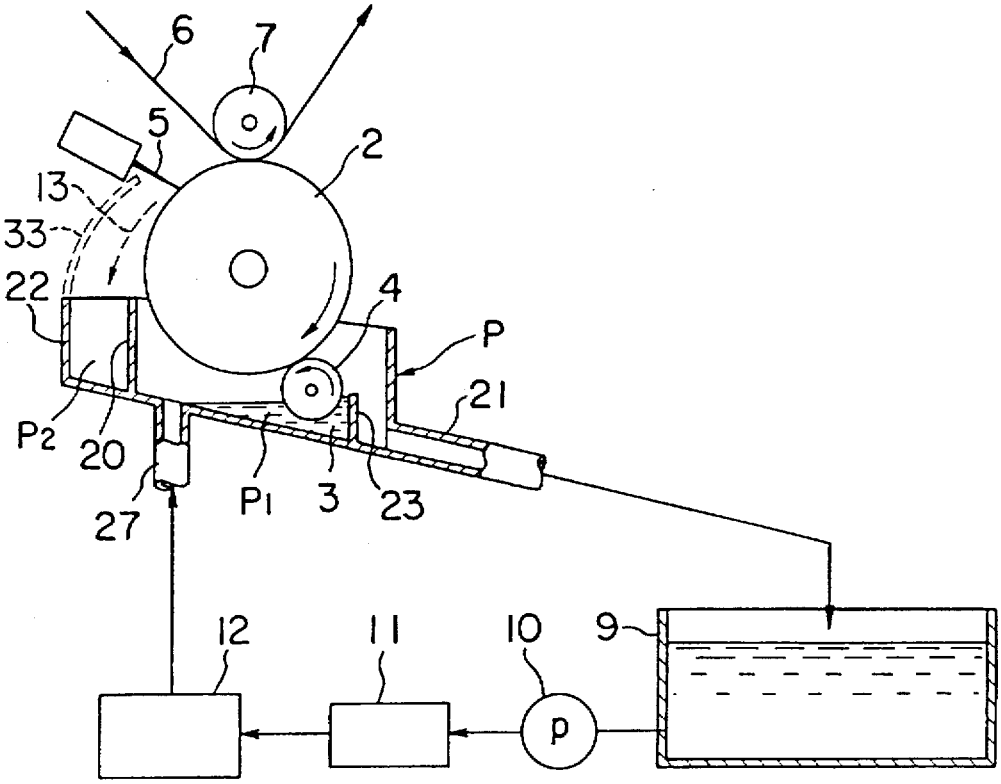
FIG. 1 is a front elevational view partly in section of a first embodiment of an inking apparatus for use in a printing press according to the present invention.
Figure 2:
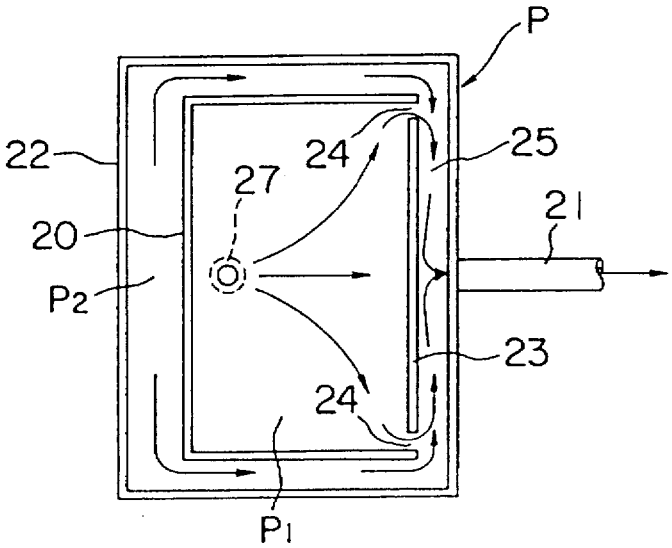
FIG. 2 is a top plan view of an ink pan shown in FIG. 1.

FIGS. 1 and 2 illustrate a first embodiment of an inking apparatus for use in a printing press according to the present invention. In FIG. 1, designated by reference numeral 2 is a plate cylinder of the printing press, under which an ink pan P is provided. Printing ink 3 is supplied into the interior of the ink pan P and is retained therein, as will be described later. A furnisher roll 4 is rotatably provided so as to be partially immersed in the ink 3, the peripheral surface of the furnisher roll 4 being in contact with the peripheral surface of the plate cylinder 2 at its diagonally lower portion. As is well known, while being rotated, the furnisher roll 4 furnishes the ink 3 to the peripheral surface of the plate cylinder 2. The rotational directions of the plate cylinder 2 and the furnisher roll 4 are indicated by their respective arrows. The top surface of the plate cylinder 2 is in pressed-contact with an impression cylinder 7 to define a nip, through which a web 6 of paper for printing is passed and delivered in the direction indicated by an arrow. Some surplus ink adhered to the peripheral surface of the plate cylinder 2 is scraped off by a doctor blade 5 and falls into the interior of the ink pan P as indicated by an arrow 13. The doctor blade 5 is positioned on the diametrically opposite side of the plate cylinder 2 with respect to the furnisher roll 4.

In this embodiment, the ink pan P consists of a first part P1 for accommodating the furnisher roll 4 and a second part P2 located below the doctor blade 5. The first part P1 and the second part P2 are partitioned from each other by a rising partition wall 20. This partition wall 20 serves as means for preventing a direct flow of the ink from the second part P2 into the first part P1 (hereinafter referred to as ink flow prevention means). The bottom wall of the ink pan P is inclined in such a manner that the second part P2 is raised and first part P1 is lowered as shown, the first part P1 having at its lowest position an ink outlet pipe 21 connected thereto.

As shown in FIG. 2, the ink pan P is provided with a rising peripheral wall 22 in the form of a quadrilateral in the example shown. The partition wall 20 is fixedly provided inside of adjacent three sides of the quadrilateral peripheral wall 22 and spaced apart from the peripheral wall 22. The partition wall 20 is absent along the remaining one side of the peripheral wall 22. Instead, a second partition wall 23 is integrally provided inside the remaining one side of the wall 22 and spaced apart therefrom, the second partition wall 23 being so arranged as to leave gaps 24 between the extremities of the second partition wall 23 and the extremities of the partition wall 20. In this manner, a passage 25 is formed between the partition wall 23 and the remaining one side of the peripheral wall 22. A space defined by the partition walls 20 and 23 forms the first part P1 of the ink pan P, while a passage defined by the partition wall 20 and the adjacent three sides of the peripheral wall 22 forms the second parts P2 of the ink pan P.

Both the first part P1 and the second part P2 communicate with the passage 25. In the case of the first part P1, the communication is made by way of the gaps 24. The passage 25 leads into the ink outlet pipe 21.

The ink outlet pipe 21 is connected to an ink tank 9. Ink within the ink tank 9 is supplied by means of a pump 10 through a filter 11 and then through a viscosity/temperature controller 12 to an ink inlet pipe 27 connected to the bottom of the first part P1 of the ink pan P. It is preferable that the bottom wall of the first part P1 of the ink pan P form a slope descending toward the second partition wall 23 as shown in FIG. 1. This structure ensures that ink 3 is dammed up by the partition wall 23 and is retained within the first part P1 as shown, thereby enabling the lower portion of the furnisher roll 4 to be immersed therein.

Description will now be given of the operation of the first embodiment set forth hereinabove.

The pump 10 is first activated in order to supply high-grade ink reservoired within the ink tank 9 to the plate cylinder 2 during the printing operation. Thus, the ink is cleared of foreign substance through the filter 11, and then is caused to have appropriately controlled viscosity and temperature through the viscosity/temperature controller 12. The ink further flows through the inlet pipe 27 into the interior of the first part P1 of the ink pan P, where it is dammed up by the second partition 23 to allow an immersion of the furnisher roll 4 therein. Thus, with rotation of the plate cylinder 2, the ink is furnished to the surface of the plate cylinder 2 by the action of the furnisher roll 4.

With further rotation of the plate cylinder 2, surplus ink imparted to the surface of the plate cylinder is scraped by the doctor blade 5, so that a proper amount of ink is provided for the printing operation. The surplus ink falls as indicated by the arrow 13 and is received within the second part P2 of the ink pan P. At that time, as a result of frictional contact between the doctor blade 5 and the surface of the plate cylinder 2, foreign substance may be produced and mixed in the ink which is falling into the second part P2 of the ink pan P. Therefore, the ink falling into the second part P2 is a contaminated ink which contains more or less foreign substance. Since it is not preferable that this contaminated ink return to the surface of the plate cylinder 2 as discussed earlier, this is prevented as follows.

The contaminated ink within the second part P2 detours around the first part P1 and flows into the passage 25 as shown in FIG. 2. This is automatically carried out by virtue of the sloped bottom wall. On the other hand, after performing the immersion of the furnisher roll 4 within the first part P1, the ink 3 flows also through the gaps 24 into the passage 25, where it joins the flow of the contaminated ink and then returns through the ink outlet pipe 21 to the ink tank 9. For this reason, the ink within the ink tank 9 comes to gradually contain more foreign substance, resulting in a degradation of the quality level. However, such a degradation of the quality level can be prevented by passing the ink within the ink tank 9 through the filter 11 to remove foreign substance therefrom. After having passed through the filter 11 and the viscosity/temperature controller 12, the ink is supplied to the ink pan P again in the form of high-grade ink. In this manner, the contaminated ink containing foreign substance is prevented from entering the ink pan P again.

Although in the first embodiment described above, the ink within the first part P1 of the ink pan P is intended to flow by way of the gaps 24 into the passage 25, the gaps 24 may be eliminated so as to enable the ink within the first part P1 to overflow the second partition wall 23 into the passage 25. Further, a cover 33 may be provided between the doctor blade 5 and the peripheral wall 22 to prevent the falling ink from the doctor blade 5 from splashing out of the ink pan P. The cover 33 is preferably fixed to the wall 22 of the ink pan P. Furthermore, the partition wall 20 may be made adjustingly movable horizontally relative to the plate cylinder 2 depending on the diameter of the plate cylinder 2. For example, if the plate cylinder 2 is of a smaller diameter than it is shown in FIG. 1, the partition wall 20 will be moved to the right. Instead of moving the partition wall 20, the ink pan P itself may be shifted horizontally relative to the plate cylinder 2 depending on the diameter thereof.

Figure 3:
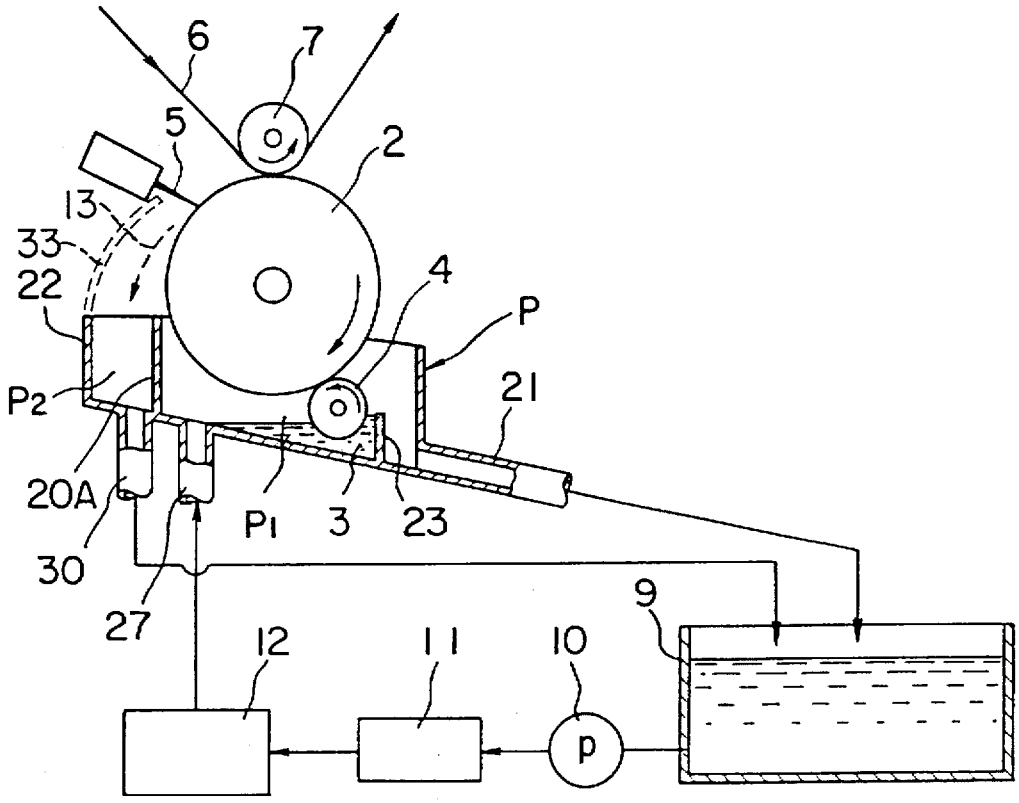
FIG. 3 is a front elevational view partly in section of a second embodiment of the present invention.
Figure 4:
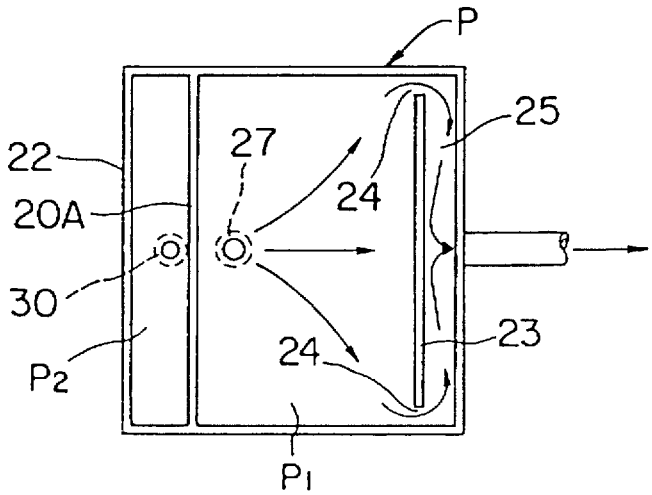
FIG. 4 is a top plan view of the ink pan shown in FIG. 3.

FIGS. 3 and 4 illustrate a second embodiment of the present invention. This embodiment is substantially the same as the first embodiment except that means are provided for transmitting contaminated ink from the second part P2 of the ink pan P to the ink tank 9. It is to be noted that the same elements or parts as those of the first embodiment are designated by identical reference numerals or marks and will not be described again. Only the differences will be described below.

In the second embodiment, a partition wall 20A is provided to separate the first part P1 and the second part P2 from each other and has terminal ends coupled to the peripheral wall 22 of the ink pan P. A contaminated ink outlet pipe 30 is connected to the bottom wall of the second part P2, the outlet pipe 30 being linked directly to the ink tank 9. Accordingly, in this embodiment, ink within the first part P1 and contaminated ink within the second part P2 are separately returned to the interior of the ink tank 9 without being intermixed. It is to be appreciated also in this embodiment that the ink within the first part P1 of the ink pan P may overflow the second partition wall 23 into the passage 25. The second embodiment will ensure that the ink pan P can be reduced in area as compared with the first embodiment.

Next, a third embodiment of the present invention will be described with reference to FIGS. 5 and 6. In order to implement the ink flow prevention means serving to prevent the contaminated ink within the second part P2 of the ink pan P from flowing directly into the first part P1 accommodating the furnisher roll 4, this embodiment employs a hydraulic head formed between the first part P1 and second part P2 instead of the partition walls employed in the first and second embodiments.

It is to be noted that elements or parts equivalent to those of the first embodiment are designated by identical reference numerals or marks and will not be described again. Only the differences will be described below. The bottom wall of the ink pan P slopes in a descending manner from the first part P1 toward the second part P2, to thereby define a head between the two parts P1 and P2. A partition wall 23A is arranged between the two parts P1 and P2 so as to leave gaps 32 between the extremities of the partition wall 23A and the peripheral wall 22. The partition wall 23A is provided to reservoir the ink 3 within the first part P1 for the immersion of the furnisher roll 4, the reservoired ink 3 flowing through the gaps 32 at the extremities of the partition wall 23A into the second part P2. It is also conceivable to enable the ink within the first part P1 to overflow the partition wall 23A with the gaps 32 removed. High-grade ink is delivered via an inlet pipe 27A into the first part P1.

The second part P2 of the ink pan P receives contaminated ink containing foreign substance which has been scraped off the plate cylinder 2, the contaminated ink being returned through an outlet pipe 30A into the ink tank 9. Since the second part P2 is located at a lower level than the first part P1 with the presence of the head, the contaminated ink after having fallen into the second part P2 is not permitted to flow into the first part P1 against the action of gravity. A direct ink flow from the second part P2 into the first part P1 is thus prevented. It will be appreciated that the head may be formed from a step between the two parts of the bottom wall, instead of the sloped bottom wall.

Figure 7:
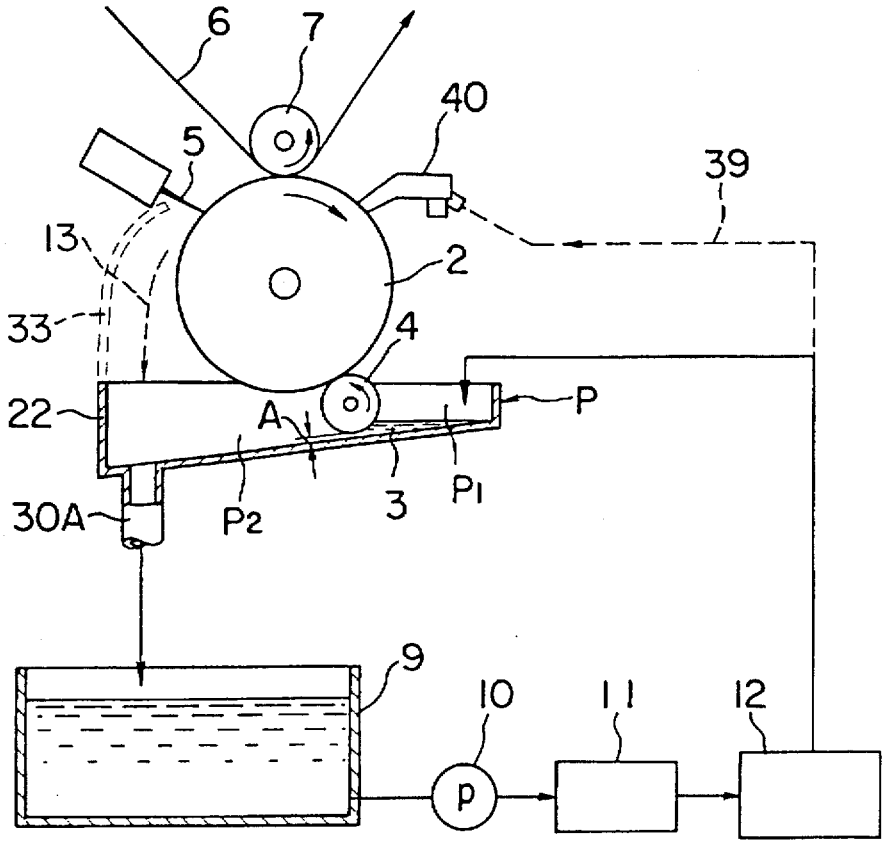
FIG. 7 is a front elevational view partly in section of a fourth embodiment of the present invention.
Figure 8:
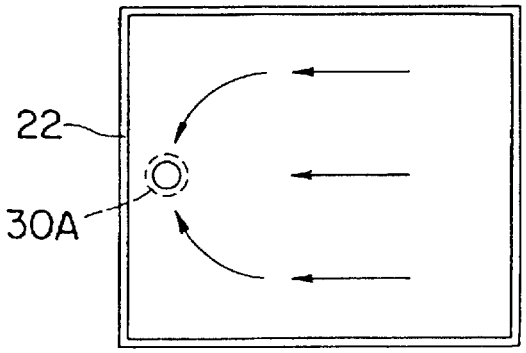
FIG. 8 is a top plan view of the ink pan shown in FIG. 7.

FIGS. 7 and 8 illustrate a fourth embodiment of the present invention. It is to be noted in this embodiment that elements or parts equivalent to those of the third embodiment are designated by identical reference numerals or marks and will not be described again. Only the differences will be described below. In order to store ink for the immersion of the furnisher roll 4, the fourth embodiment makes use of the furnisher roll 4 itself, instead of using the partition wall 23A as shown in FIG. 5. More specifically, the furnisher roll 4 is positioned to leave a small gap A between the bottom portion of the furnisher roll 4 and the inclined bottom surface of the first part P1, allowing the ink to flow only through the gap A into the second part P2. Ink 3 is thus dammed up and stored. Also in this embodiment, the second part P2 is located at a lower level than the first part P1, with the result that a head can be utilized to prevent a direct inflow of the contaminated ink from the second part P2 into the first part P1. It is also conceivable to provide a step between the two parts P1 and P2.

As shown in FIG. 7, an ink applicator 40 may be provided diagonally above the plate cylinder 2 in close proximity thereto and opposite to the doctor blade 5, the ink applicator 40 serving to supply the plate cylinder 2 with ink received from the ink tank 9 by way of a line 39. It will be understood that the applicator 40 may be additionally provided for the first to third embodiments.

Figure 5:
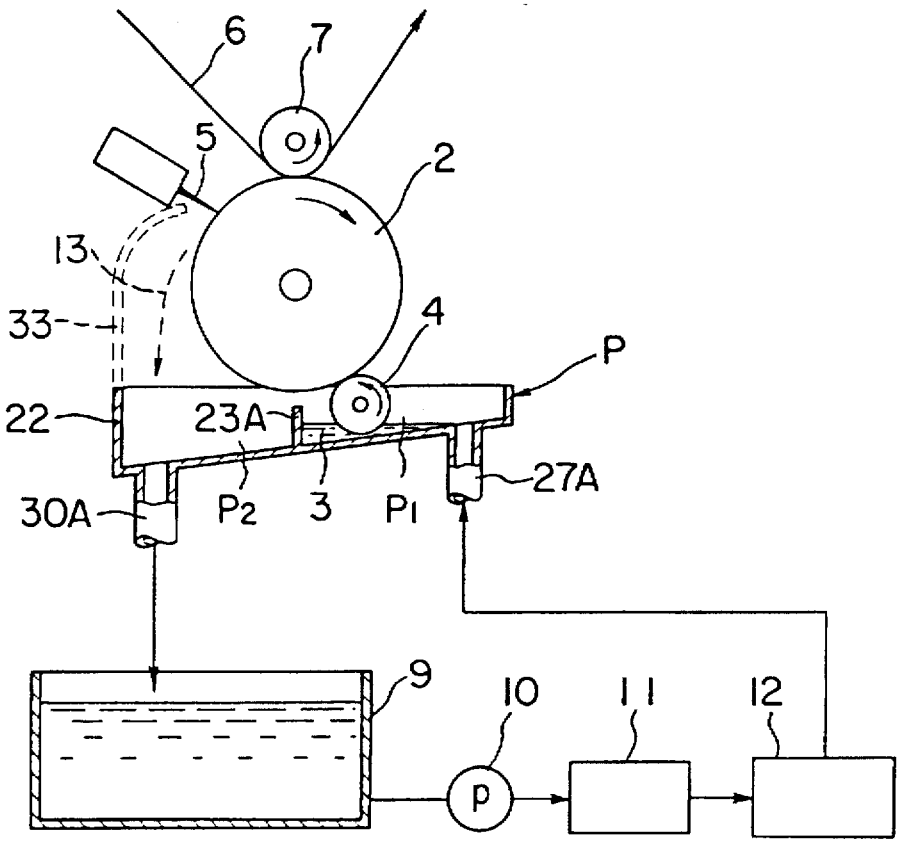
FIG. 5 is a front elevational view partly in section of a third embodiment of the present invention.
Figure 6:
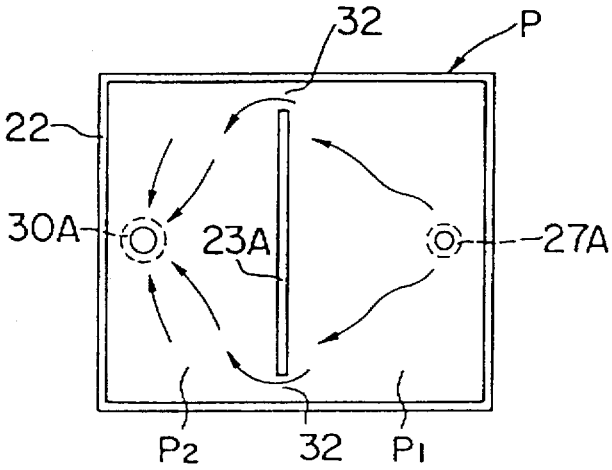
FIG. 6 is a top plan view of the ink pan shown in FIG. 5.
Figure 9:
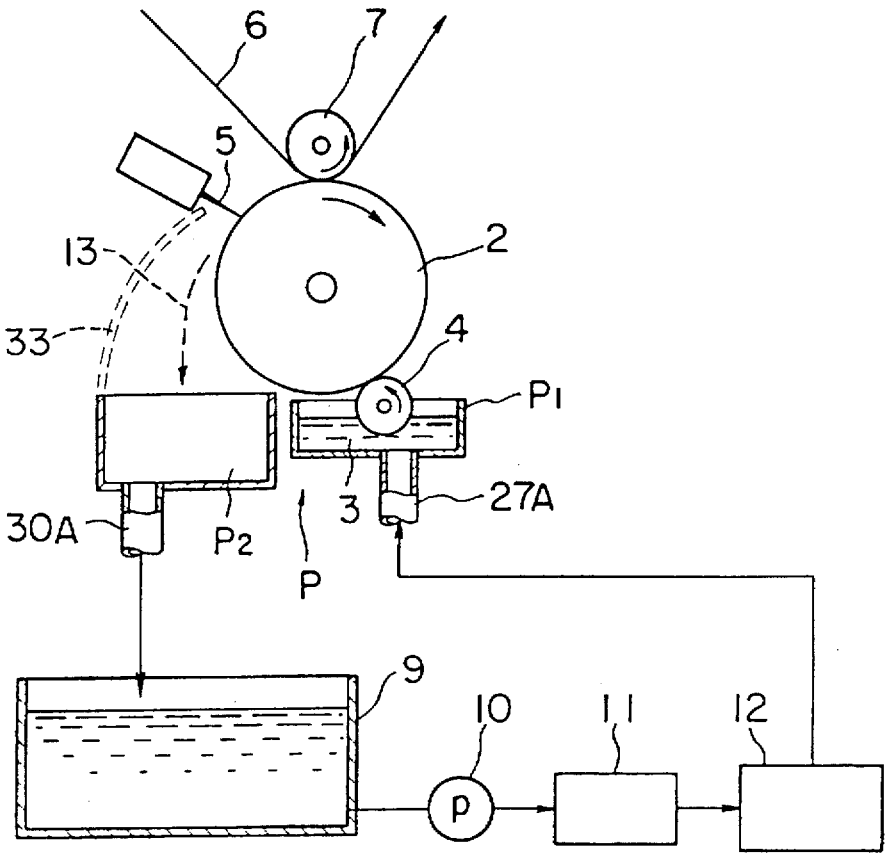
FIG. 9 is a front elevational view partly in section of a fifth embodiment of the present invention.

FIG. 9 illustrates a fifth embodiment obtained through a minor design change of the third embodiment shown in FIG. 5. The fifth embodiment employs a constitution including the first part P1 and the second part P2 which are comprised of entirely separate receptacles to interrupt the communication between the two parts, although the third embodiment employs the partition wall 23A to isolate the first part P1 from the second part P2 of the ink pan P. The operation and effect of the fifth embodiment is the same as those of the third embodiment.

Figure 10:
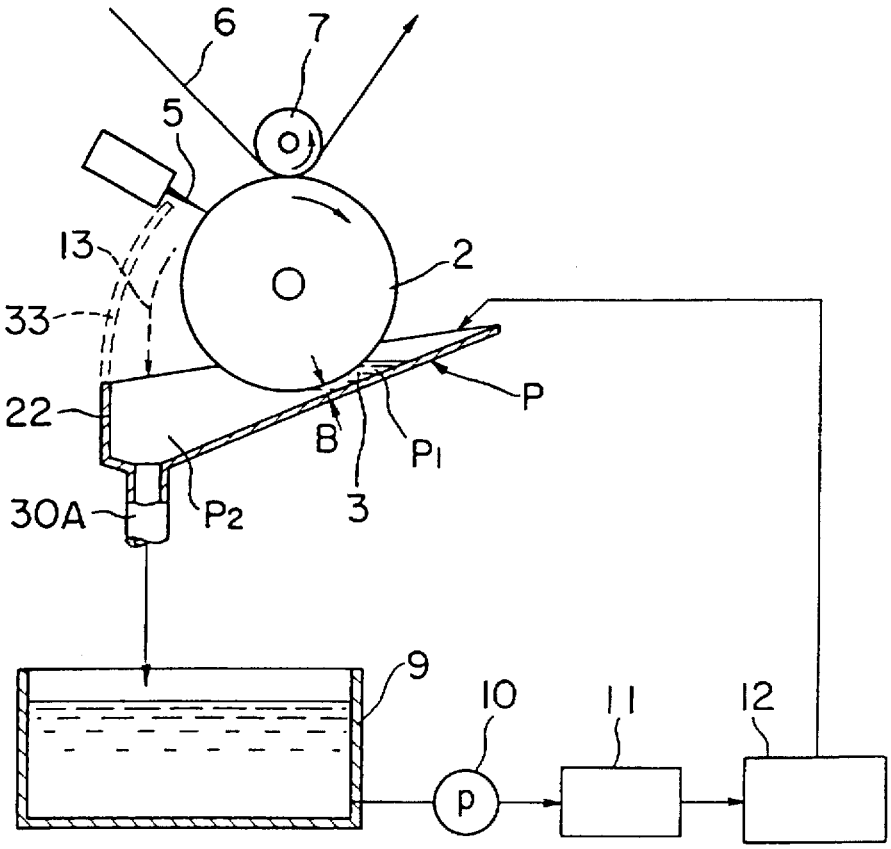
FIG. 10 is a front elevational view partly in section of a sixth embodiment of the present invention.

FIG. 10 illustrates a sixth embodiment of the present invention. The sixth embodiment employs a constitution in which the plate cylinder 2 is immersed directly in the ink 3 retained within the ink pan P without using the furnisher roll 4, as in the previous embodiments, as means for furnishing high-grade ink onto the surface of the plate cylinder 2. The FIG. 7 embodiment has left only a small gap A between the bottom portion of the furnisher roll 4 and the bottom surface of the first part P1 so as to permit the ink to flow only through the gap A into the second part P2 to thereby dam up and store the ink 3 within the first part P1. In the same manner, the FIG. 10 embodiment also leaves only a small gap B between the bottom portion of the plate cylinder 2 and bottom surface of the first part P1, with the bottom wall of the ink pan P descending from the first part P1 toward the second part P2, so as to permit the ink to flow only through the gap B into the second part P2 to thereby dam up and store the ink 3 within the first part P1, whereby ink is furnished onto the surface of the plate cylinder 2 with the rotation of the plate cylinder 2.

In this sixth embodiment, after having being supplied through the pump 10, the filter 11 and through the viscosity/temperature controller 12 into the ink pan P, high-grade ink is furnished directly to the plate cylinder 2, allowing the remaining ink to flow through the gap B into the second part P2 and then to return through the ink outlet pipe 30A into the ink tank 9. Due to the slope descending from the first part P1 of the ink pan P toward the second part P2, this embodiment will also ensure positive prevention of upflow, from the ink pan second part P2 into the first part P1, of the contaminated ink containing foreign substance scraped off the plate cylinder 2.

Figure 11:
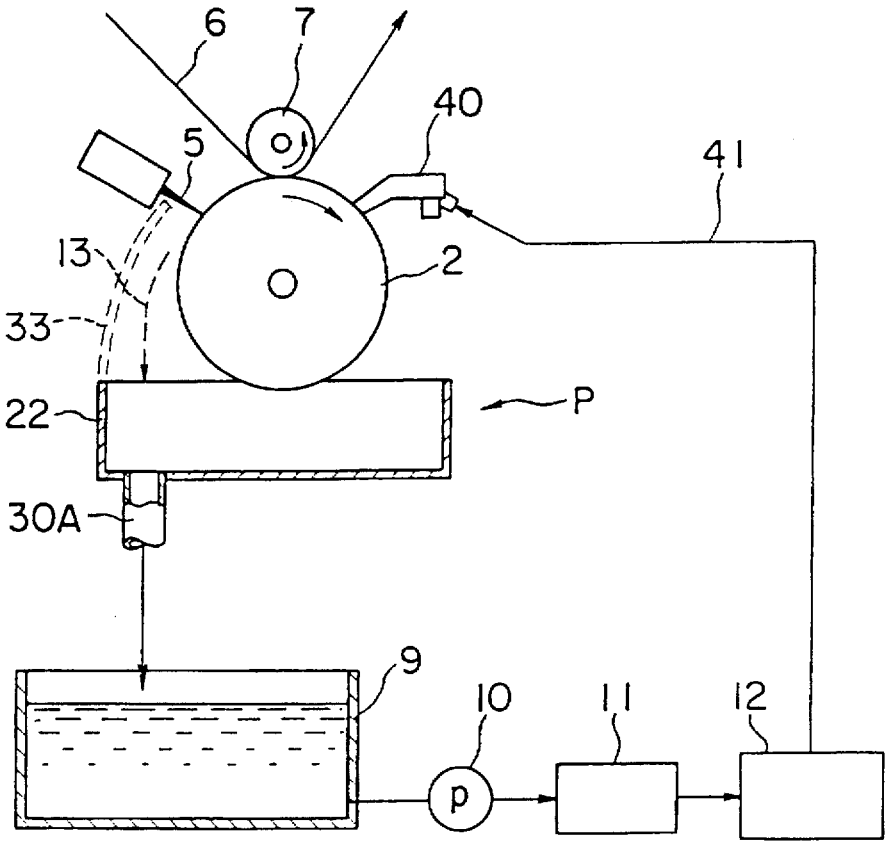
FIG. 11 is a front elevational view partly in section of a seventh embodiment of the present invention.

FIG. 11 illustrates a seventh embodiment of the present invention. This embodiment employs an ink applicator 40 similar to that shown in FIG. 7, as means for furnishing high-grade ink onto the surface of the plate cylinder 2. More specifically, the applicator 40 receives ink from the ink tank 9 by way of a line 41, and furnishes ink to the plate cylinder 2 from diagonally above.

The ink pan P on the other hand is in the form of an exclusive ink pan for receiving the contaminated ink containing foreign substance scraped off the plate cylinder 2, without being separated into the first part and the second part as in the embodiments set forth hereinabove. The other constitution is substantially the same as those of the previously described embodiments. This embodiment enables the contaminated ink containing foreign substance which has fallen into the ink pan P to be discharged through the ink outlet pipe 30A into the ink tank 9, so that a possibility is eliminated of the contaminated ink being mixed with the high-grade ink furnished onto the surface of the plate cylinder 2 from the ink applicator 40.

In the inking apparatus for use in a printing press according to the present invention as described above, the means are provided for preventing surplus ink which has fallen into the ink pan from the contact area between the plate cylinder surface and the doctor blade from flowing directly into an ink path of the means for furnishing ink onto the plate cylinder surface, thereby prohibiting a direct flow of the contaminated ink containing foreign substance scraped off the plate cylinder into the ink path of the means for furnishing ink onto the plate cylinder surface. Thus, the present invention positively eliminates a possibility that the contaminated ink adversely affects the high-grade ink to be furnished to the plate cylinder, while simultaneously maintaining the quality of ink and ensuring an improved quality level of printed matter, free from any printing trouble.

In the case of the ink pan having the first part and the second part, it will be simple and advantageous in design to provide a partition wall as means for preventing the contaminated ink retained within the second part from flowing into the first part.

It will also be simple and can be achieved at low cost to provide a head, for example, an inclination as means for preventing the contaminated ink stored within the second part from flowing into the first part.

Furthermore, in the case of the ink pan having the first part and the second part, it will be simple in design and advantageous to employ two separate receptacles defining the first and second parts, as means for preventing the contaminated ink collected within the second part from flowing into the first part.

It will also ensure a positive prevention of mixing of the ink containing foreign substance with the high-grade ink to employ an ink pan comprised merely of a portion for receiving the contaminated ink containing the foreign substance scraped off the plate cylinder and to provide the supply path of the high-grade ink to the plate cylinder surface without passing through the interior of the ink pan.

The above detailed description should be construed as illustrative rather than limiting, and it should be understood that it is the following claims, including all equivalents, that are intended to define the scope of the present invention.

What is claimed is:

1. A printing press comprising:

a plate cylinder;

an upwardly open ink pan having a first part and a second part, said first part being disposed below said plate cylinder and having ink retaining means on a bottom thereof;

an ink furnisher roll disposed under said plate cylinder in contact therewith and positioned relative to said ink retaining means to be dipped in an ink in said ink retaining means;

a doctor blade provided in contact with an outer surface of said plate cylinder for removing surplus ink resting on said surface of said plate cylinder, said doctor blade being positioned on a lateral side of the said plate cylinder;

said second part of the said ink pan being located substantially below said lateral side of said plate cylinder for receiving therein surplus ink scraped off by said doctor blade from said surface of said plate cylinder;

an ink tank;

ink supply means for supplying an ink from said ink tank through a filter into said ink retaining means; and surplus ink discharge means for discharging surplus ink that has been received in said second part of said ink pan into said ink tank.

2. The printing press according to claim 1, wherein said bottom of said first part of said ink pan is sloped and said ink pan further comprises an upstanding partition wall on said bottom thereof to form said ink retaining means.

3. The printing press according to claim 1, wherein said ink pan is divided into said first part and said second part by means of a partition wall.

4. The printing press according to claim 1, wherein said second part of said ink pan has a bottom which is at a lower level than said bottom of said first part and said first part is in communication with said second part so that ink in said first part will flow by gravity into said second part.

5. The printing press according to claim 4, wherein a bottom of said second part and said bottom of said first part form a continuous slope.

6. The printing press according to claim 1, wherein said bottom of said first part of said ink pan is sloped and said furnisher roll is disposed above said sloped bottom with a clearance therebetween to form said ink retaining means.

7. The printing press according to claim 1, wherein said first part and said second part are separated.

8. The printing press according to claim 1, further comprising a cover provided over said second part of the said ink pan to prevent surplus ink scraped off by said doctor blade from splashing outside said ink pan.

9. A printing press comprising:

a plate cylinder;

an upwardly open ink pan having a first part and a second part, said first part being disposed below said plate cylinder and having a sloping bottom, said plate cylinder being disposed above said sloping bottom of said ink pan with a clearance therebetween to form ink retaining means;

a doctor blade provided in contact with an outer surface of said plate cylinder for removing surplus ink resting on said surface of said plate cylinder, said doctor blade being positioned on a lateral side of said plate cylinder;

said second part of said ink pan being located substantially below said lateral side of said plate cylinder for receiving therein surplus ink scraped off by said doctor blade from said surface of said plate cylinder;

an ink tank;

ink supply means for supplying an ink from said ink tank through a filter into said ink retaining means; and surplus ink discharge means for discharging surplus ink that has been received in said second part of said ink pan into said ink tank.

10. The printing press according to claim 9, further comprising a cover provided over said second part of said ink pan to prevent surplus ink scraped off by said doctor blade from splashing outside said ink pan.

11. A printing press comprising:

a plate cylinder;

an upwardly open ink pan disposed below said plate cylinder;

an ink applicator provided adjacent said plate cylinder;

a doctor blade provided in contact with an outer surface of said plate cylinder for removing surplus ink resting on said surface of said plate cylinder, said doctor blade being positioned on a lateral side of said plate cylinder;

said ink pan extending to a location substantially below said lateral side of said plate cylinder for receiving therein surplus ink scraped off by said doctor blade from said surface of said plate cylinder;

an ink tank;

ink supply means for supplying an ink from said ink tank through a filter to said ink applicator;

surplus ink discharge means for discharging surplus ink that has been received in said ink pan into said ink tank; and a cover provided over a said second part of said ink pan to prevent surplus ink scraped off by the doctor blade from splashing outside said ink pan.

* * * * *